US007388179B2

(12) United States Patent
Alton et al.

(10) Patent No.: US 7,388,179 B2
(45) Date of Patent: Jun. 17, 2008

(54) MICROWAVE RADIATING APPLICATOR WITH REDUCED SENSITIVITY TO SURROUNDING MEDIA

(75) Inventors: William J. Alton, Pepperell, MA (US); Lester C. Nelson, Mason, NH (US)

(73) Assignee: The Ferrite Company, Inc., Nashua, NH (US)

( * ) Notice: Subject to any disclaimer, the term of this patent is extended or adjusted under 35 U.S.C. 154(b) by 0 days.

(21) Appl. No.: 10/846,002

(22) Filed: May 14, 2004

(65) Prior Publication Data

US 2004/0256384 A1 Dec. 23, 2004

Related U.S. Application Data

(60) Provisional application No. 60/471,401, filed on May 16, 2003.

(51) Int. Cl.
*H05B 6/78* (2006.01)

(52) U.S. Cl. ..... 219/690; 219/695; 219/746; 219/750; 333/34

(58) Field of Classification Search ..... 219/690–697, 219/745–750; 333/32–35
See application file for complete search history.

(56) References Cited

U.S. PATENT DOCUMENTS 2,480,682 A * 8/1949 Stiefel ..... 219/696
2,811,624 A * 10/1957 Haagensen ..... 219/695
4,684,776 A 8/1987 Heard
4,853,507 A * 8/1989 Samardzija ..... 219/696
6,034,362 A 3/2000 Alton
6,274,858 B1 8/2001 Alton

OTHER PUBLICATIONS

Rueggeberg, W., "A Multislotted Waveguide Antenna for High-Powered Microwave Heating Systems", *IEEE Transactions on Industry Applications*, vol. 1A-16, No. 6, pp. 809-813 Nov./Dec. 1980.

* cited by examiner

*Primary Examiner*—Philip H Leung
(74) *Attorney, Agent, or Firm*—Hamilton, Brook, Smith & Reynolds, P.C.

(57) ABSTRACT

A microwave energy applicator radiating uniformly all around the applicator that maintains high efficiency Voltage Standing Wave Ratio (V.S.W.R.) for surrounding media of dielectric constants varying from about 1 to about 80. In a particular embodiment, the high efficiency V.S.W.R. is less than about 1.3:1. The applicator can include a circular polarizer connectable to a dielectric waveguide radiator. The radiator can be substantially solid and include a substantially circular outer cross-section that tapers to an end. In one embodiment, the radiator includes a conical void formed in a dielectric entry section.

10 Claims, 2 Drawing Sheets

MICROWAVE RADIATING APPLICATOR WITH REDUCED SENSITIVITY TO SURROUNDING MEDIA

RELATED APPLICATION

This application claims the benefit of U.S. Provisional Application No. 60/471,401, filed May 16, 2003, the entire teachings of which are incorporated herein by reference.

BACKGROUND OF THE INVENTION

It is often a requirement to place an energy applicator in an area where the surrounding media may change with time and/or application of power. This occurs, for example, in soil remediation and heating of viscous oil deposits, where the applicator may be surrounded by air, gas, water, or hydrocarbons, individually or in mixtures. The transmission of substantial amounts of microwave power is most efficiently done by a waveguide. However, this requires sealing and pressurization of itself and the applicator to prevent inflow of the items being heated.

The previous approaches have used slotted waveguide applicators. Slots are typically on the broad wall of the waveguide. See, for example, W. Rueggeberg in "A Multi-slotted Waveguide Antenna for High-Powered Microwave Heating Systems", *IEEE Transactions on Industry Applications*, Vol. 1A-16, Number 6, pp 809-813, November/December 1980.

SUMMARY OF THE INVENTION

However, radiation from a slot in a metal waveguide varies as a function of the dielectric characteristics of the surrounding media. This means that a slotted radiator with a high efficiency (low Voltage Standing Wave Ratio (V.S.W.R.)) in air will typically have a poor efficiency (high V.S.W.R.) in water. Slotted radiators must be sealed if fouling is to be avoided.

A further problem for radiators using a rectangular waveguide is that the heating effects are not uniform around the applicator because the rectangular guide includes four planar surfaces. Whether the slots are in the broad walls or the narrow walls of the waveguide, the radiation is essentially radiating with the maximum intensity perpendicular to the plane of the surface in which the slot is cut.

An embodiment of the invention provides for a uniform radiation around an applicator while maintaining high efficiency for a wide range of surrounding media.

A microwave energy applicator is provided for radiating uniformly all around the applicator. The applicator can provide a relatively uniform radiation to a variety of surrounding media and maintains high efficiency Voltage Standing Wave Ratio (V.S.W.R.) for media surrounding the applicator having dielectric constants from about 1 to about 80. In a particular embodiment, the high efficiency V.S.W.R. is less than about 1.3:1. The even energy spread radially throughout 360 degrees around the applicator is achieved by maintaining circular symmetry throughout the radiator, and launching circularly polarized microwaves into the radiator from a round waveguide. The circularly polarized waves in the round waveguide are produced in one embodiment using a rectangular-to-round waveguide transformer and a cylindrical section containing an asymmetrical insert or inserts.

The applicator includes a circular polarizer or guide connectable to a dielectric waveguide radiator, which can be substantially solid. In one embodiment, the radiator includes a conical void in a dielectric entry section to provide tapered matching from the air-(or other suitable gas) filled circular guide to the solid dielectric waveguide. The radiator can include a substantially circular outer cross-section that tapers to an end. In a specific embodiment, the radiating section of the radiator is polypropylene.

The polarizer can include one or more asymmetrical inserts for providing a circularly polarized microwave energy output given a linearly polarized microwave input.

A microwave energy applicator is provided in accordance with other aspects of the present invention comprising a circular polarizer connectable to a dielectric waveguide radiator. The radiator can include a substantially circular outer cross-section that tapers to an end and a conical void formed in a dielectric entry section. A flange is connectable between the polarizer and the radiator.

In one embodiment, the radiator includes polypropylene and is substantially solid. The polarizer can include one or more asymmetrical inserts for providing a circularly polarized microwave energy output given a linearly polarized microwave input. In a particular embodiment, the polarizer includes a substantially circular outer cross-section.

A microwave energy applicator is further provided comprising a circular polarizer connectable to a substantially solid dielectric waveguide radiator. The radiator can include a conical void formed in a dielectric entry section. The dielectric material for the radiator is selected so that for dimensions compatible with the high-power circular waveguide feed, it functions as a leaky waveguide. In this manner, the radiator radiates from its sides while continuing some of the energy forward. The leakage rate from the waveguide varies depending on its surroundings. The resulting radiation is uniform radially at any point and is spread relatively uniformly along the length.

The applicator can provide a relatively uniform radiation to a variety of surrounding media and maintains high efficiency Voltage Standing Wave Ratio (V.S.W.R.) for media surrounding the applicator having dielectric constants from about 1 to about 80. In a particular embodiment, the high efficiency V.S.W.R. is less than about 1.3:1.

BRIEF DESCRIPTION OF THE DRAWINGS

The foregoing and other objects, features and advantages of the invention will be apparent from the following more particular description of various embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of various embodiments of the invention follows.

Figure 1:
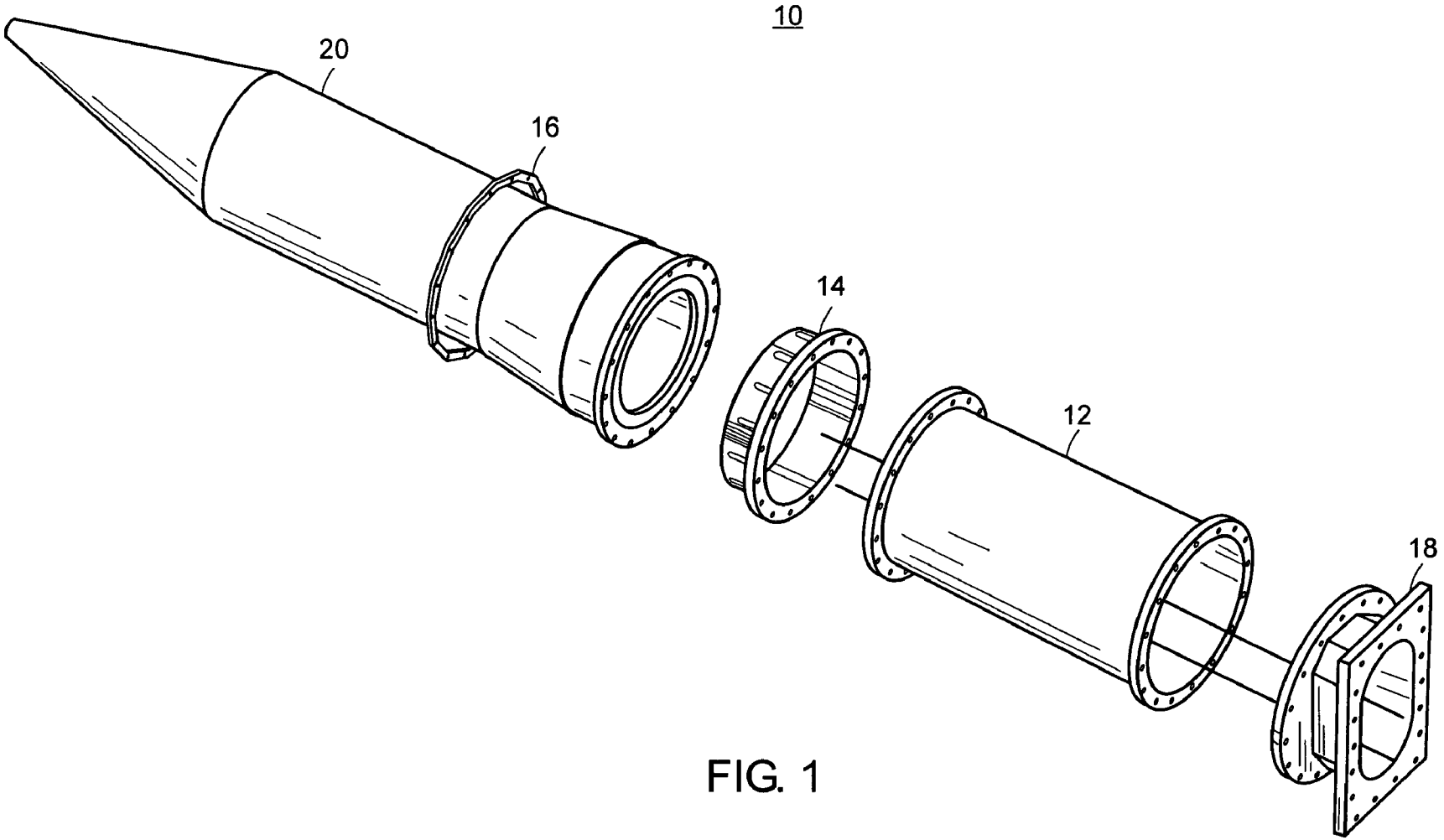
FIG. 1 is a perspective view of a microwave applicator according to an embodiment of the present invention.
Figure 3:
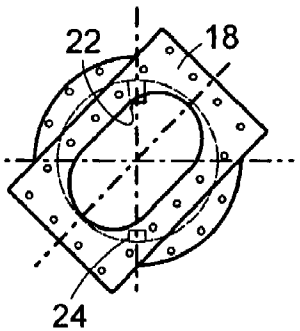
FIG. 3 is an end view of the applicator.

FIG. 1 is a perspective view of the components of a microwave applicator 10 constructed in accordance with principles of the present invention. The applicator 10 includes a circular polarizer section 12, a flange 14, a sealing ring or clamp plate 16, a rectangular-to-round transformer 18, and a dielectric waveguide radiator 20. The applicator 10 is of particular use in heating a surrounding media that may change over time or be unknown. This situation can occur in soil remediation and heating of viscous oil deposits that occur in oil deposit exploration. In such environments, the applicator 10 may be surrounded by, for example, air, gas, water, hydrocarbons, and soil materials individually and/or in mixtures.

Furthermore, in cold weather environments, it is possible that the surrounding media may actually change with the application of microwave energy. Prior to application of the energy, the surrounding media may include frozen water, ice and oil mixture; however, once microwave energy begins to be applied in the surrounding media, the ice melts thereby forming water. The media then changes its composition and its ability to absorb microwave energy.

Figure 2:
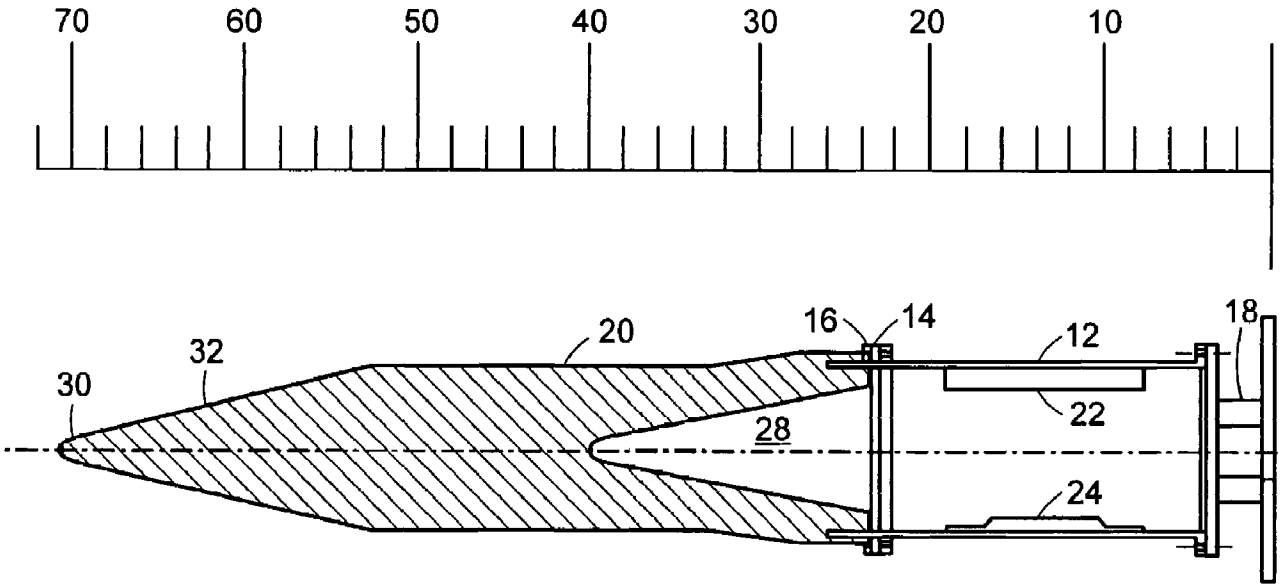
FIG. 2 is a longitudinal cross-sectional view of the applicator.

FIG. 2 is a longitudinal cross-sectional view of the applicator 10. The scale above FIG. 2 is in inches. This embodiment is for operation at about 915 MHz using a dielectric radiator 20 made of polypropylene. It can be seen here more particularly that the circular polarizer 12 contains a cylindrical section piece having one or more asymmetrical inserts 22 and 24. The circular polarizer 12 provides a circularly polarized microwave output when a linearly polarized wave is supplied to it through the rectangular-to-round transformer 18 at a 45 degree angle to the asymmetrical insert or inserts 22 and 24.

This method to provide a circularly polarized wave is the same as described in U.S. Pat. No. 6,034,362 issued to Alton, entitled "Circularly Polarized Microwave Energy Feed" in March 2000 and assigned to the Ferrite Company, and also in U.S. Pat. No. 6,274,858 issued to Alton entitled "Bends in a Compact Circularly Polarized Microwave Feed" in August 2001, also assigned to the Ferrite Company.

In one embodiment, the dielectric waveguide radiator 20 is generally cylindrical in shape, and has circular symmetry about a center axis. A conical void 28 is formed in a dielectric entry section. An exterior taper portion 32 carries from a midsection out towards the tip or end 30. In a particular embodiment, the radiator 20 is substantially solid.

For high-power transmission, to avoid overheating of the dielectric radiators, which can cause thermal stress and damage, a low loss dielectric, such as polypropylene, can be used. When a solid dielectric waveguide is made of polypropylene, which can have a dielectric constant of about 2.2, and with a diameter close to that of the single mode $TE_{11}$ circular energy waveguide, the propagation is leaky even when surrounded by air. Energy containment in a dielectric waveguide relies on a larger dielectric constant of the waveguide compared to its surroundings so air is the worst case for radiation.

The diameter of the solid radiator 20 was selected to allow just sufficient radiation in air to have a good match (low reflection) for four foot long dielectric radiators. This was thought to be compatible with achieving suitable energy densities in soil remediation applications where the heating is required to be spread to the surroundings without excessive hot spots.

Tapers can be provided at each end of the solid dielectric portion 20. One is a conical void 28 inside the radiator 20, and provides a gradual impedance transition for the circular metal waveguide 12 to the solid dielectric guide 20. The taper 32 at the front to the rounded end 30 provides a gradual transition, from a portion of the waveguide that is leaking energy radiating while transporting it, to no waveguide. As the diameter of the dielectric radiator 20 decreases towards the end 30, its ability to contain energy decreases resulting in increased radiation.

The radiation is radially uniform around the dielectric radiator 20 at substantially all cross-sections. The distribution along the radiator 20 length shifts for different surrounding media. For air, the radiation is relatively uniform along the length while for higher dielectric constants, such as water, the radiation is almost complete at the start of the taper 32.

The leaky dielectric waveguide radiator 20 is connected to the polarizer 12 by a metal flange 14 with a bolt-on clamp plate 16. This provides an O-ring pressure seal to the radiator 20.

The conical void 28 inside the radiator 20 provides a match to the empty or hollow circular polarizer 12.

The outer diameter of the radiator 20 is tapered 32 to provide effective leakage radiation where the tubular piece becomes solid. In this manner, the end 30 can radiate the remaining microwave energy uniformly over a short length.

In a particular embodiment, the dielectric material that forms radiator 20 includes polypropylene, although other low dielectric loss materials are suitable.

While this invention has been particularly shown and described with references to various embodiments thereof, it will be understood by those skilled in the art that various changes in form and details may be made therein without departing from the scope of the invention encompassed by the appended claims.

What is claimed is:

1. A microwave energy device comprising:

a dielectric waveguide applicator, having an applicator input and applicator end, the waveguide also having a generally circular cross section, and the waveguide being formed from a solid dielectric material along at least fifty percent (50%) of its overall length, the waveguide further comprising:

a center portion, having a substantially constant outer diameter, and solid interior portion;

an entry portion, disposed adjacent the center portion, and having an outer diameter that tapers from a first relatively larger outer diameter adjacent the applicator input, to a first relatively smaller outer diameter adjacent the center portion, the entry portion also having a tapered conical void formed within that presents a decrease in void diameter with distance from the applicator input; and an exit taper portion, disposed on a side of the center portion opposite the entry portion, the exit taper portion having a solid interior portion, and having an outer diameter that tapers from a second relatively larger outer diameter adjacent the center portion to a second relatively smaller outer diameter adjacent the applicator end.

2. A microwave energy applicator as in claim 1, providing radiation uniformly all around the applicator that maintains high efficiency Voltage Standing Wave Ratio (V.S.W.R.) for surrounding media of dielectric constants varying from about 1 to about 80.

3. The applicator of claim 2, wherein the high efficiency V.S.W.R. is less than about 1.3:1.

4. The applicator of claim 1, wherein the dielectric material includes polypropylene.

5. The applicator of claim 1, wherein the applicator provides a relatively uniform radiation to a variety of surrounding media.

6. The microwave energy applicator device of claim 1 additionally wherein the tapered conical void further extends into a first part of the center portion, such that a thickness of the an exterior wall of the first part of the center portion increases with distance from the applicator input.

7. The microwave device of claim 1 additionally comprising:

a circular polarized, coupled to the waveguide applicator, for applying circulatory polarized microwave energy thereto.

8. The applicator of claim 7, wherein the conical void has a taper selected for providing an impedance match between the waveguide radiator and the polarizer.

9. The applicator of claim 7, wherein a flange is connected between the circular polarizer and the waveguide radiator.

10. The applicator of claim 7, wherein the circular polarizer includes one or more asymmetrical inserts for providing a circularly polarized microwave energy output from a linearly polarized microwave input signal.

* * * * *